US007882967B2

(12) United States Patent
Hynes

(10) Patent No.: US 7,882,967 B2
(45) Date of Patent: Feb. 8, 2011

(54) MODULAR WINE RACK SYSTEM

(75) Inventor: India Hynes, Newport Beach, CA (US)

(73) Assignee: Vinotemp International, Inc., Rancho Dominguez, CA (US)

( * ) Notice: Subject to any disclaimer, the term of this patent is extended or adjusted under 35 U.S.C. 154(b) by 0 days.

(21) Appl. No.: 11/957,991

(22) Filed: Dec. 17, 2007

(65) Prior Publication Data

US 2009/0152221 A1 Jun. 18, 2009

(51) Int. Cl.
*A47B 73/00* (2006.01)

(52) U.S. Cl. ..... 211/75

(58) Field of Classification Search ..... 211/74, 211/75, 57.1, 59.1, 70.6, 87.01, 193, 181.1, 211/70.5, 100, 106
See application file for complete search history.

(56) References Cited

U.S. PATENT DOCUMENTS

| | | | | | |
|---|---|---|---|---|---|
| 698,272 | A * | 4/1902 | Glover | 211/39 |
| 2,490,994 | A * | 12/1949 | Brown | 211/96 |
| 2,527,796 | A * | 10/1950 | Clute | 211/74 |
| 2,951,590 | A * | 9/1960 | Feser | 211/75 |
| 3,160,278 | A * | 12/1964 | Varkala | 211/74 |
| 3,606,023 | A * | 9/1971 | Edmunds | 211/74 |
| 3,870,155 | A * | 3/1975 | Galloway | 211/74 |
| D243,738 | S * | 3/1977 | Johnson | D7/704 |
| 4,998,631 | A * | 3/1991 | Fridjhon | 211/74 |
| 5,002,190 | A * | 3/1991 | Moreland | 211/32 |
| 5,499,724 | A * | 3/1996 | Hickman | 211/70.6 |
| 5,518,127 | A * | 5/1996 | Warmack et al. | 211/193 |
| D376,299 | S * | 12/1996 | Audet | D7/704 |
| D378,888 | S * | 4/1997 | Bertilsson | D7/704 |
| 5,865,326 | A * | 2/1999 | Spamer et al. | 211/181.1 |
| 6,173,845 | B1 * | 1/2001 | Higgins et al. | 211/74 |
| 6,390,309 | B1 * | 5/2002 | Tucker | 211/85.7 |
| 6,502,705 | B1 * | 1/2003 | Ziegler | 211/74 |
| D483,233 | S * | 12/2003 | Chen | D7/704 |
| 6,763,956 | B2 * | 7/2004 | Woods | 211/74 |
| D497,526 | S * | 10/2004 | Sanders et al. | D7/707 |
| 6,991,117 | B2 * | 1/2006 | McCain | 211/75 |
| 7,051,984 | B2 * | 5/2006 | Botkin | 248/220.31 |
| 2007/0039907 | A1 * | 2/2007 | Zandt | 211/57.1 |
| 2007/0068887 | A1 * | 3/2007 | Richard Nawrocki | 211/70.6 |
| 2008/0189858 | A1 * | 8/2008 | Merritt | 5/503.1 |

* cited by examiner

*Primary Examiner*—Jennifer E. Novosad
(74) *Attorney, Agent, or Firm*—Kleinberg & Lerner, LLP; Marvin H. Kleinberg

(57) ABSTRACT

A modular wine rack system stores wine with the label facing the user, having at least two identical rods with indentations sized to hold a wine bottle. The rods are attached to a wall or frame to extend there from. The rods may be spaced apart so that the bottles are stored angled downwardly, with the body supported on one rod and the neck supported on the other.

5 Claims, 4 Drawing Sheets

MODULAR WINE RACK SYSTEM

BACKGROUND

1. Field of the Invention

The present invention relates to wine racks and, more particularly, wine racking devices.

2. Background of the Invention

Traditional wine racks stored bottles of wine in square or circular compartments, to maximize the number of bottles that could be stored against a wall. These compartments extended orthogonally from the wall such that wine bottles were inserted base first, with only the mouth and cork of the bottle visible from the outside. This was problematic to a person trying to select a wine bottle from such a rack, because the label which distinguishes one wine bottle from another is on the body of the bottle, not at the mouth and cork.

Another problem with traditional wine racks is that they were not modular. Typical wine racks were built in large units that covered entire walls. This led to much wasted space for users who did not have enough wine to fill the rack. Modular wooden racks using dowels to create a rack, enable the same kind of storage with bottles orthogonal to a wall with only the corks readily visible. However, this assembly method allowed as much wine rack as was needed for the available space.

Subsequent art in the wine rack field disclosed racks made of wood, wire, or metal. Some were modular, but others were decorative, with a predetermined number of storage spaces. These racks offered several advantages. The racks were cheaper to produce, lightweight, portable, and easy to install. However, these racks persisted in storing the wine orthogonal to the viewer. These iterations of wine racks did not solve the key problem of making the label visible to a viewer while the bottle was still in the rack.

Later model wine racks have utilized horizontal racking, and improved on the label viewing problem. These racks held bottles parallel to the wall by using a pair of arms, one of which had a large depression to hold the body of the bottle, the other with a smaller depression to hold the neck of the bottle. (See the McCain U.S. Pat. No. 6,991,117.) The racks stored wine so that the labels were visible. A disadvantage to this system was that it required two different arms to support a bottle.

Several wine rack systems were developed that allowed some modularity, typically by stacking small wine racks next to and on top of each other, thereby creating "one" larger wine rack. These systems suffered from two flaws: first, because each unit in the modular system was itself a small wine rack, the user still often had wasted space.

For example, a typical iteration included small racks capable of holding six bottles of wine. If a user acquired only two new bottles of wine, adding a new module wasted the space for the extra four bottles.

The second problem is related to the first. Because each module was composed of a complete, smaller rack, the individual parts were not interchangeable and replaceable. If part of one module was misplaced or damaged then the entire module could become unusable. At best, space for one bottle became unusable. The consumer was typically forced to replace the entire module, not just the damaged component, because the individual components were not sold.

It is the aim of the present invention to provide a modular wine rack system that stores wine bottles so that a viewer can read the labels. It is an additional aim of the present invention to provide a rack that can be adapted to store wine horizontally, for sales displays, or at an angle, to keep the cork of a partially full bottle moist. It is a further aim of the present invention to provide a wine rack that is modular, replaceable, and inexpensive to manufacture. It is yet an additional object to provide a universal arm with uniform sized depressions that can be used as an element in a wine storage system. Such arms can have one or more depressions so that a pair of arms can support one or more bottles. Further, the depressions could be sufficiently large to support a range of bottle sizes—from magnum to splits.

Wine rack systems are created by using appropriate arm supporting elements. These arms can be wall mounted adapted to fit into peg board systems, could be fitted into wall mounted slots or could be combined with vertical posts that are fitted with a base to provide a stand alone wine storage system.

SUMMARY OF THE INVENTION

A universal arm is provided with indentations to create resting positions for a bottle of wine. Each arm is composed of metal or another substance suitable for supporting one or more bottles of wine. Depending upon the number of bottles to be supported, the arm can have one or more depressions. In addition, each arm has mounting means at one end which may be used to mount the arm onto a pegboard, framework, horizontal slot, or the like. A pair of arms extend substantially perpendicular to the mounting surface and are spaced apart sufficiently to accommodate a wine bottle in the indentations provided. A pair of arms can then receive bottles in the curved depressions.

By varying the horizontal distance between the arms a user can alter the orientation of wine bottles stored in the curved depressions. By placing the arms relatively close together, a bottle can be stored substantially horizontally, because the body of the bottle rests in both curved depressions of the arms. However, if the arms are spaced further apart, the neck of the bottle will rest in one of the curved depressions, giving the bottle an orientation tilted substantially downward. It will be apparent to one skilled in the art that the present invention is capable of storing other bottle types in addition to wine bottles, and if the depression is sufficiently large, various bottle sizes, ranging from magnums to splits, can be accommodated.

Further, by not aligning the two arms in the same horizontal plane, the bottles can be stored at a desired angle to ensure that the cork will be kept moist at all times, or alternatively, with the neck slightly raised so that sediment collects at the bottom of the bottle.

DETAILED DESCRIPTION OF THE INVENTION

Figure 1:
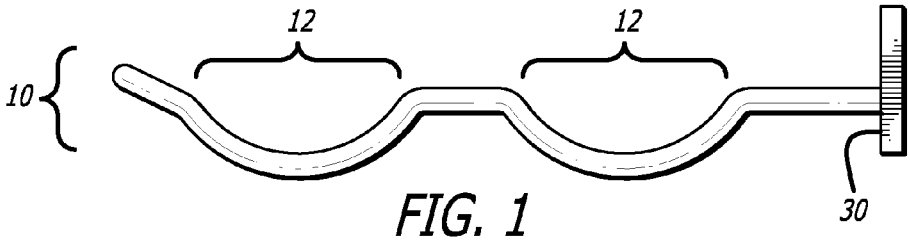
FIG. 1 is a side view of a support arm according to the present invention.

Turning first to FIG. 1, a side view of a support arm 10 is shown. In a first embodiment two curved lengths of the arm 10 form two concave resting positions 12 where bottles (not shown) may rest. These resting positions 12 may be nearly any size, diameter, or shape without departing from the spirit of the invention, so long as they are capable of supporting a bottle. It is understood that the depressions are of a uniform size, requiring only a single arm style to fully support a bottle.

Figure 2:
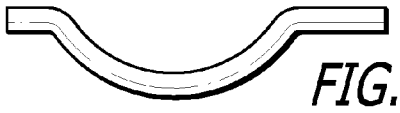
FIG. 2 is a side view of an alternative embodiment of a support arm.
Figure 3:
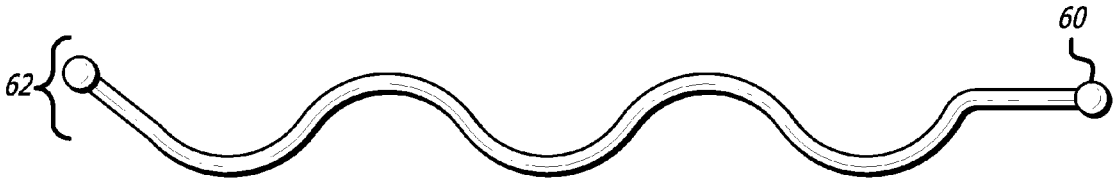
FIG. 3 is a side view of another alternative embodiment of a support arm.
Figure 5:
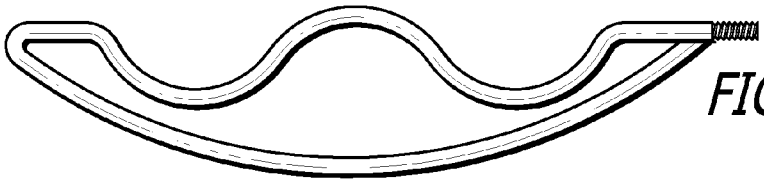
FIG. 5 is a side view of a support arm that incorporates an additional structural member.
Figure 6:
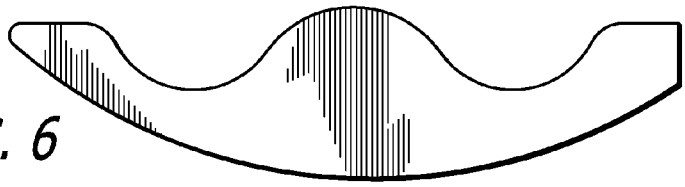
FIG. 6 is a side view of a support arm adapted to hold heavy bottles.

Although two depressions or resting positions 12 are shown in this embodiment, the invention is not so limited. One, two, three, or even more depressions or resting positions 12 may be included on a support arm 10, so long as the arm 10 is capable of supporting the weight of the equivalent number of full bottles. For example, FIG. 2 shows an arm with only one depression and FIG. 3 shows an arm with three depressions. Additionally, the cross sectional shape of the supporting arm 10 may be a circle, square, oval, or virtually any other shape without departing from the essence of the invention. To facilitate the support of a large number of bottles, alternative embodiments of the support arm may include integrated supports. For example, FIG. 5 illustrates an arm with an under hanging support arm. FIG. 6 demonstrates an arm and support constructed from one continuous material, with depressions simply cut out of the top of the material.

Figure 7:
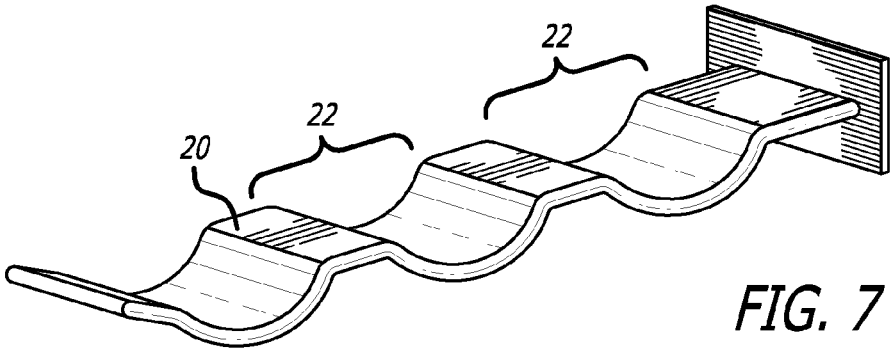
FIG. 7 contains a top and side view of a support arm constructed from a flat sheet of material.

FIG. 7 details an alternative embodiment of a support arm 20. The arm 20 may be composed of wood, metal, plastic, or any other material suitable for supporting the weight of full bottles. In this embodiment, the support arm 20 is constructed from, for example, a sheet of metal. A metal arm is bent to form multiple resting positions 22 for bottles.

Figure 8:
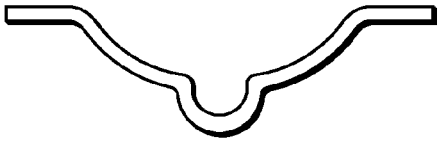
FIG. 8 is a side view of an alternative embodiment of a support arm.

FIG. 8 illustrates yet another alternative embodiment of a support arm 24. In this embodiment the resting positions 26 are specifically adapted to receive either the body or neck of a bottle. As in other embodiments of the invention, only one arm style is required to fully support a bottle. A first arm 24 can support the neck of a bottle in the small indentation of the resting position 26 while a second arm 24 can support the body of a bottle in the main resting position 26.

Figure 9:
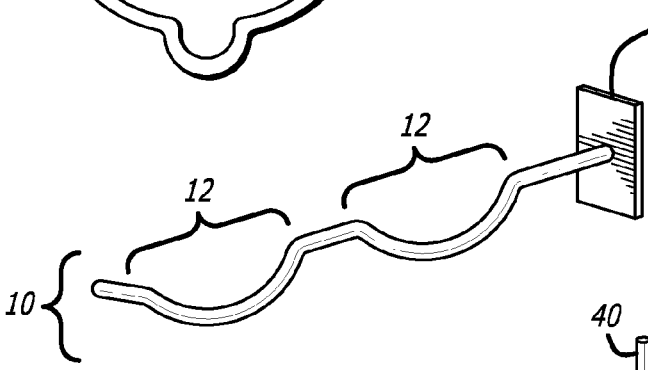
FIG. 9 is an isometric view of a support arm illustrating one embodiment of mounting means.

FIG. 9 is an isometric view of the support arm 10 depicted in FIG. 1. At the end of the support arm 10 are mounting means, in this embodiment, a plate 30. The plate 30 can be utilized with mounting systems that provide a horizontal slot (not shown) to accommodate product dispensers. Using this mounting system allows the user to easily configure a rack to individual tastes. The user can configure a rack to support bottles (not shown) substantially horizontally by spacing two identical support arms 10 relatively close together so that the body of the bottle is supported in resting positions 12. Conversely, the user can configure the rack to support bottles angled substantially downward by spacing the support arms 10 further apart, so that the neck of the bottle rests in one of the resting positions 12.

Figure 10:
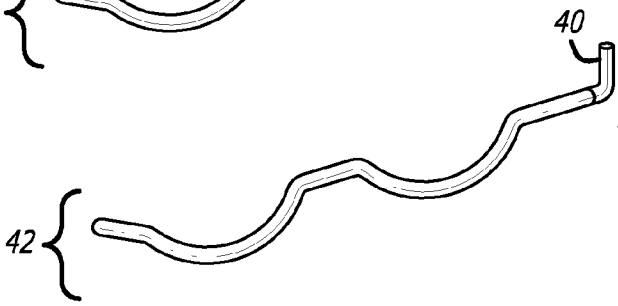
FIG. 10 is an isometric view of a support arm detailing an alternative embodiment of mounting means.

An alternative embodiment is depicted in FIG. 10. In this embodiment, the plate 30 of FIG. 8 is replaced with a hook 40 suitable for insertion into a peg board (not shown) or similar mounting structure. Similar to the prior embodiment, this mounting also provides the user with an opportunity to personalize how wine is stored by spacing support arms 42 to a preferred distance, as well as by vertical separation.

Figure 11:
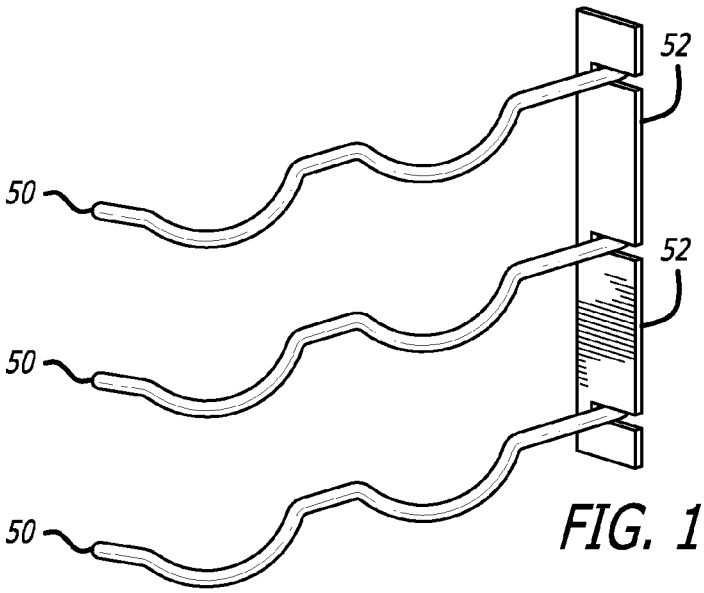
FIG. 11 is an isometric view of support arms attached to yet another embodiment of mounting means.
Figure 13:
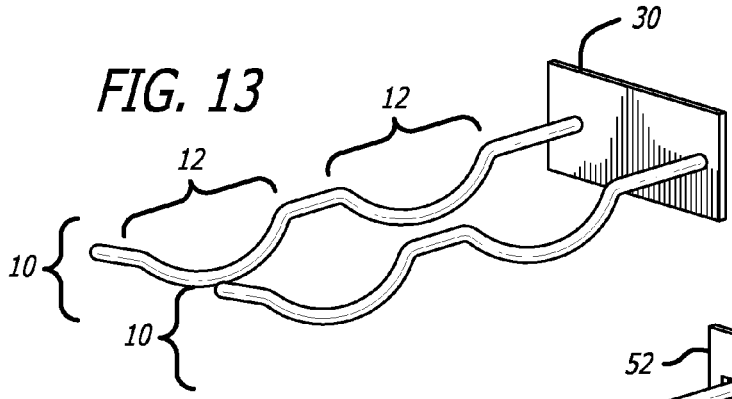
FIG. 13 is an isometric view of a pair of support arms.
Figure 14:
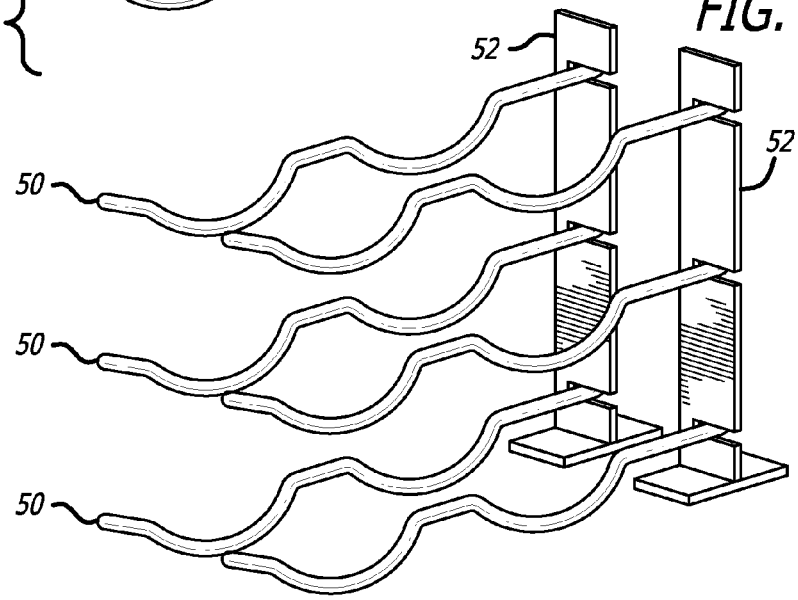
FIG. 14 is an isometric view of a pair of frames with attached support arms.
Figure 15:
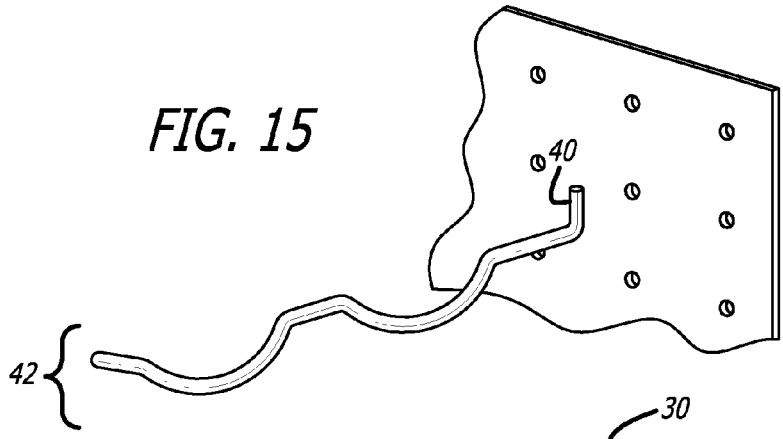
FIG. 15 is a support arm with a pegboard.
Figure 16:
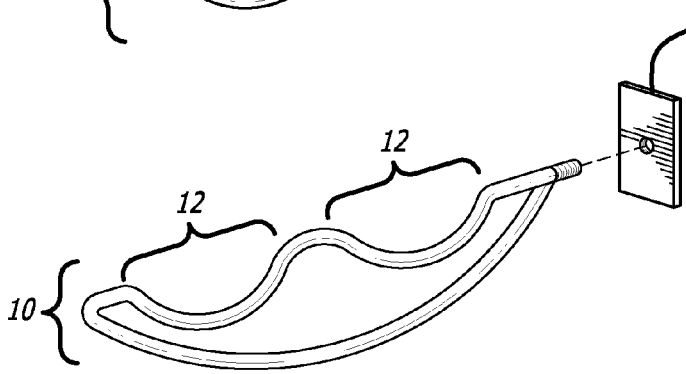
FIG. 16 is a support arm with threaded terminus and a threaded receiver.
Figure 17:
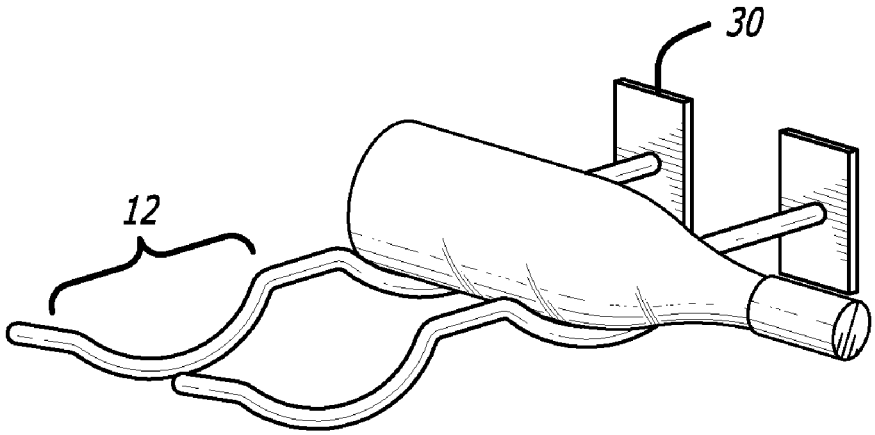
FIGS. 17 and 18 are views of the bottle in $1^{st}$ and $2^{nd}$ positions.
Figure 18:
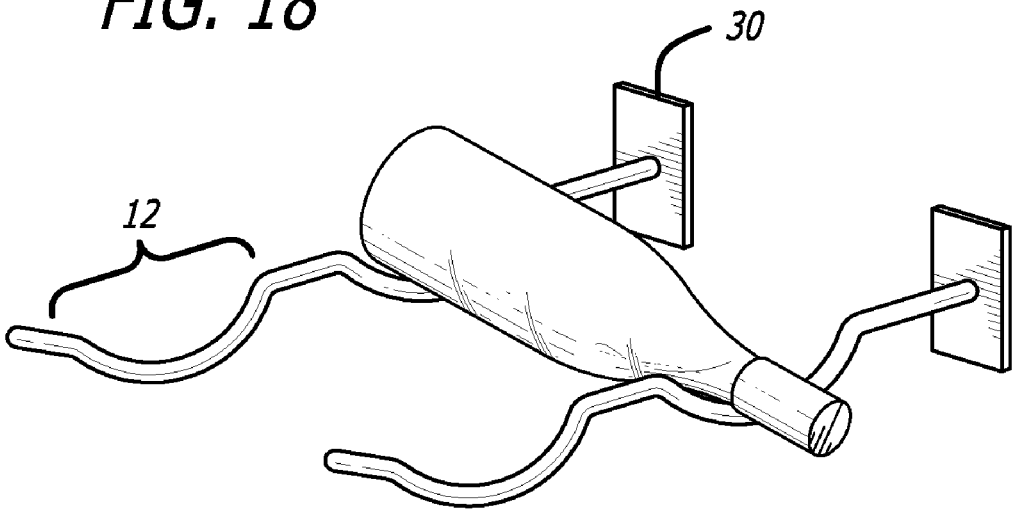

FIG. 11 demonstrates yet another method of mounting support arms 50. In this embodiment, a plurality of support arms 50 are vertically integrated into a mounting frame 52. The mounting frame 52 may be composed of wood, metal, plastic, or any other suitable material. The mounting frame 52 can then be mounted on a wall or on a freestanding base pedestal with a second similar mounting frame 52 to form a complete rack.

As disclosed above, the user can modify the orientation of stored bottles merely by varying the space between mounting frames 52. It will be apparent to one skilled in the art that the mounting frame 52 may be any height, and include any number of support arms 50 without varying from the spirit of the invention. The methods of attaching the support arms 50 to the mounting frame 52, and the mounting frame 52 to the wall or freestanding base pedestal are well know in the art, and thus are not described here.

Figure 12:
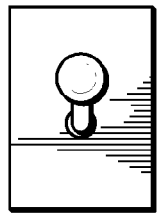
FIG. 12 illustrates a "keyhole" style mounting means.

The mounting means of the present invention are not limited to the preceding examples, and may be virtually any means capable of mounting support arms to a wall or frame. For example, an alternative embodiment of the mounting means is illustrated in FIGS. 3 and 12. In FIG. 3, a small ball 60 at the end of a support arm 62 is sized such that it fits through the wide top portion of a keyhole slot shown in FIG. 12. FIG. 12 is a reverse view of the keyhole slot; the ball 60 located at the end of the arm 62 has entered the slot. The ball 60 will be locked into place, securing the arm 62, when it slides downward into the narrower part of the slot.

Figure 4:
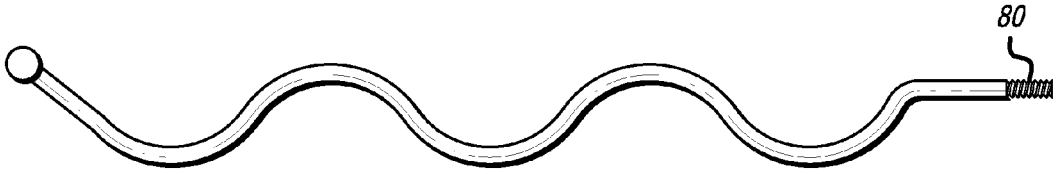
FIG. 4 is a side view of yet another alternative embodiment of a support arm.

Yet another mounting means is shown in FIG. 4. One end of a support arm is threaded like a wood screw 80. It is then screwed into a corresponding hole in a wall or frame. Other suitable mounting means will be apparent to one skilled in the art.

What is claimed is:

1. A modular wine rack system comprising:

a pair of substantially identical support arms for supporting wine bottles having a body and a neck, each of said arms having a proximal end and a distal end, each of said support arms having at least one indentation capable of supporting a wine bottle, and each of said indentations having substantially identical dimensions;

wherein each of said support arms has mounting means at said proximal end mounting said support arms in a cantilevered position and wherein each of said distal ends is free; and a support means receiving said pair of support arms substantially horizontally aligned in a cantilevered position and spaced apart to receive a wine bottle in said indentations; and wherein said support arms can be disposed in two different positions by adjusting the distance therebetween such that in a first one of the positions, said support arms are spaced relatively close together so that the body of a wine bottle is supported by an indentation in each of the support arms thereby supporting said wine bottle in a substantially horizontal position and, alternatively, in a second one of said positions, said support arms are spaced relatively further apart so that the body of the wine bottle is supported by an indentation in one support arm and the neck of the bottle is supported by an indentation in the other support arm thereby supporting said wine bottle with its neck angled downwardly.

2. The wine rack system of claim 1 wherein said support arms have one indentation.

3. The wine rack system of claim 1 wherein said support arms have two indentations.

4. The wine rack system of claim 1 wherein said support arms have at least three indentations.

5. The wine rack system of claim 1 wherein said mounting means are a vertical plate.

* * * * *